US005805112A

United States Patent [19]

Cassel

[11] Patent Number: 5,805,112

[45] Date of Patent: Sep. 8, 1998

[54] EXTRA ANTENNA ELEMENT

[75] Inventor: Jan Cassel, Djursholm, Sweden

[73] Assignee: Ericsson Inc., Research Triangle Park, N.C.

[21] Appl. No.: 656,901

[22] Filed: Jun. 3, 1996

Related U.S. Application Data

[63] Continuation of Ser. No. 274,450, Jul. 13, 1994, abandoned.

[30] Foreign Application Priority Data

Jul. 14, 1993 [SE] Sweden ..... 9302420

[51] Int. Cl.[6] ..... H01Q 1/24

[52] U.S. Cl. ..... 343/702; 343/791; 343/846; 343/895

[58] Field of Search ..... 343/702, 749, 343/752, 790–792, 846, 848, 895; H01Q 9/28, 1/24

[56] References Cited

U.S. PATENT DOCUMENTS

| | | | |
|---|---|---|---|
| 2,805,414 | 9/1957 | Taylor | 343/792 |
| 3,932,873 | 1/1976 | Garcia | 343/792 |
| 4,138,681 | 2/1979 | Davidson et al. | 343/702 |
| 4,442,438 | 4/1984 | Siwiak et al. | 343/792 |
| 4,494,122 | 1/1985 | Garay et al. | 343/749 |
| 4,543,581 | 9/1985 | Nemet | 343/702 |

FOREIGN PATENT DOCUMENTS

| | | |
|---|---|---|
| 0 367 609 | 5/1990 | European Pat. Off. . |
| 0 528 775 | 2/1993 | European Pat. Off. . |
| 468 917 | 4/1993 | Sweden . |
| 2 141 878 | 1/1985 | United Kingdom . |

*Primary Examiner*—Michael C. Wimer
*Attorney, Agent, or Firm*—Burns, Doane, Swecker & Mathis, L.L.P.

[57] ABSTRACT

A method and an arrangement uses an extra member intended to be connected to the ordinary grounding plane system of an antenna through a portion a the coaxial input terminal sleeve being present outside the case of an apparatus. The extra member is tuned in such a way that it preferably operates as an electrical quarter-wave radiator in a range at the upper limit of a designed operating frequency range, while the remaining effective grounding plane system of the antenna is preferably tuned to a frequency in a range at the lower limit of the intended operating frequency range, where, for instance, a portable radio telephone should operate, to in this way obtain an increased bandwidth and a reduced influence of immediate surrounding environment of the antenna of the portable equipment.

12 Claims, 5 Drawing Sheets

EXTRA ANTENNA ELEMENT

This application is a continuation of application Ser. No. 08/274,450, filed Jul. 13, 1994, abandoned.

TECHNICAL FIELD

The present invention relates to a method and an arrangement utilizing said method to improve the efficiency and the bandwidth of an antenna, and particularly the present invention relates to a method and an arrangement to minimize the influence on the antenna, for instance, by a hand of a user holding a pocket telephone provided with a compact antenna.

BACKGROUND OF THE INVENTION

An antenna for a pocket telephone is usually formed as a short antenna member which electrically corresponds to a length of a half-wave or a quarter-wave at the operating frequency of said pocket telephone.

The Swedish published patent application SE 468 917, having the same assignee as the present application, discloses an example of such a compact miniature antenna having essentially a rectangularly shaped current distribution between the base and the top and which member is quite suitable as an antenna for a pocket telephone.

However, a remaining problem for such an antenna to operate fairly satisfactory is that it generally demands the presence of a grounding plane to form an efficacious antenna system. Normally, if the case of the pocket telephone is conducting, that should constitute a grounding plane for the antenna. However this has the drawback that there might be troublesome uncontrolled circulating currents in the equipment, which currents also may have an injurious effect on the possibility of the antenna system to properly radiate radio energy.

An common way as was demonstrated in the above published patent application SE 468 917, is to make a particular, usually also tuned, grounding plane connected to the antenna to form an antenna system, and to have this grounding plane insulated from the rest of an eventually conducting structure of the pocket telephone. This grounding plane then must be placed immediately adjacent to the antenna itself, which is normally positioned at the top of the equipment and adjacent to the portion the user will put to his ear, but, as demonstrated in the published patent application, avoiding to bring down the grounding plane to the portion of the equipment which will be enclosed by the hand of a user. However, the hand and the ear will, for instance, influence the tuning of this grounding plane system and the antenna because a part of the irradiated energy by the field distribution in the antenna near field will be transferred to the equipment chassis and the designer therefore has little control of the grounding plane function, which thus will be dependent of the way a user holds the telephone.

U.S. Pat. No. 4,138,681 discloses an antenna for a handheld radio transceiver including a first and a second element to minimize surface currents across the radio's body, thereby substantially eliminating power loss caused by absorption in the user's body. However this antenna has a size which is approximately 8 times larger compared to the antenna disclosed in the above referred Swedish published patent application SE 468 917.

Another document GB-A-2 141 878 discloses an antenna comprising a coaxial feeder to obtain good stability and bandwidth. However the antenna size will be increased by $\lambda/50$ which should correspond to an order of increase by 20% in antenna size for the design according to said Swedish published patent application SE 468 917.

Therefore, there is still a desire to attain an arrangement in connection with such an antenna for a pocket telephone, which as far as possible will reduce the influence on the general function of the antenna by the body of a user. Simultaneously there is a wish to be able to make the antenna as broadbanded as possible, to have the pocket telephone operating within a wider frequency range.

SUMMARY OF THE INVENTION

A first object of the present invention is, by means of a method and an arrangement utilizing said method, to attain an antenna, for instance for a pocket telephone, which is less sensitive to the proximity of a user.

An additional object by the method and the device according to the present invention is to attain an antenna having a radiation impedance which will be less dependent of the unit onto which the antenna is mounted, whereby is achieved a generally better average efficiency of the antenna.

Another further object by the method and the arrangement according to the present invention is to attain an antenna which generally demonstrates a radiation impedance having a small variation within a predefined operating frequency range, in other words an improved bandwidth of the antenna, so that a wider operating frequency range will be available for transmitting equipment connected to the antenna.

BRIEF DESCRIPTION OF THE DRAWINGS

The invention, together with additional objects and advantages thereof, may best be understood by making reference to the following description taken together with the accompanying drawings, in which.

AN ILLUSTRATIVE EMBODIMENT

Figure 1:
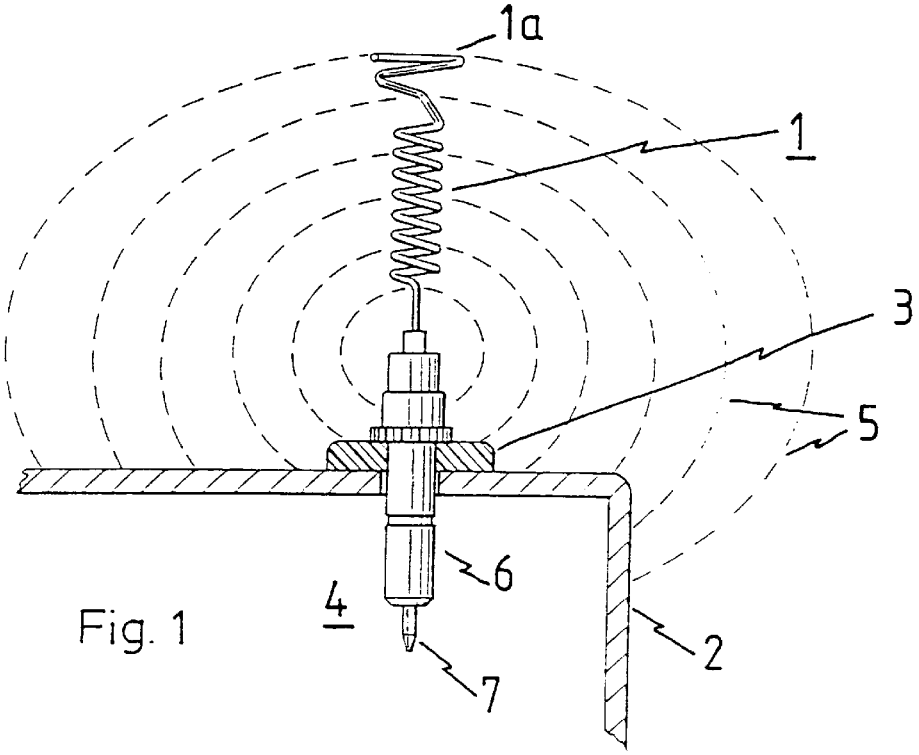
FIG. 1 demonstrates an antenna according to the state of the art mounted onto a portable equipment and having a part of its surrounding electric field indicated.

FIG. 1 illustrates an antenna 1 for an equipment in the shape of a handheld mobile telephone according to the state of the art. Associated with a case 2 of the equipment, onto which the antenna is mounted, there is a built-in grounding plane system (not shown) which above the equipment chassis is connected to an antenna coaxial sleeve 6. In the illustrative embodiment, the antenna 1 consists of an antenna element made as a vertical helix, preferably constituting a quarter-wave resonator for the operating frequency range of the equipment and which fundamentally has an essentially rectangular current distribution between the base and the top. The antenna element is connected to the equipment by a coaxial terminal 4, which together with an insulating washer 3 is inserted into the case 2. The central pin 7 of the coaxial terminal 4 is connected to the radio transceiver common output/input, while the other pole of the radio transceiver common output/input is connected to the outer sleeve 6 of the coaxial terminal 4 and is thereby connected to the equipment built-in grounding plane system, which normally is electrically insulated from the usually electrically conducting case of the apparatus. Additionally in practice the complete antenna device is embedded into a cover (not shown) of non-conducting material, for instance silicon rubber, to protect the antenna element.

FIG. 1 also illustrates outlined dashed electric field lines 5 around the antenna element of an operating equipment. This radiation field is influenced greatly by the case 2 of the equipment and contributes to energy transfer to the case and will thus further contribute to the influence by the proximity of a user, for instance, when he holds the equipment and puts the apparatus to his ear.

Figure 3A:
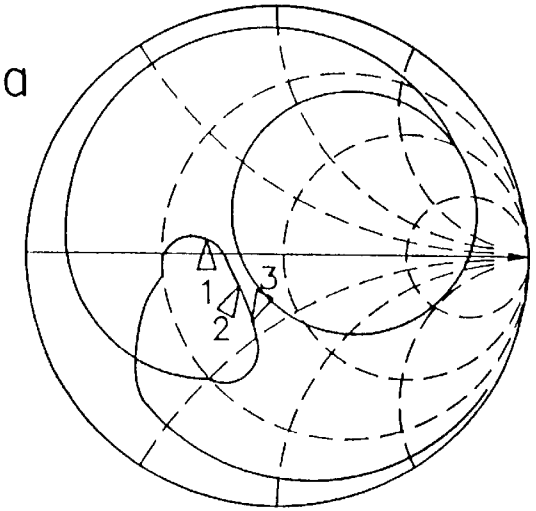
FIGS. 3*a*–3*b* are a Smith diagram and a plot of the standing wave ratio for the antenna according to FIG. 1 when experiencing no external influence
Figure 3B:
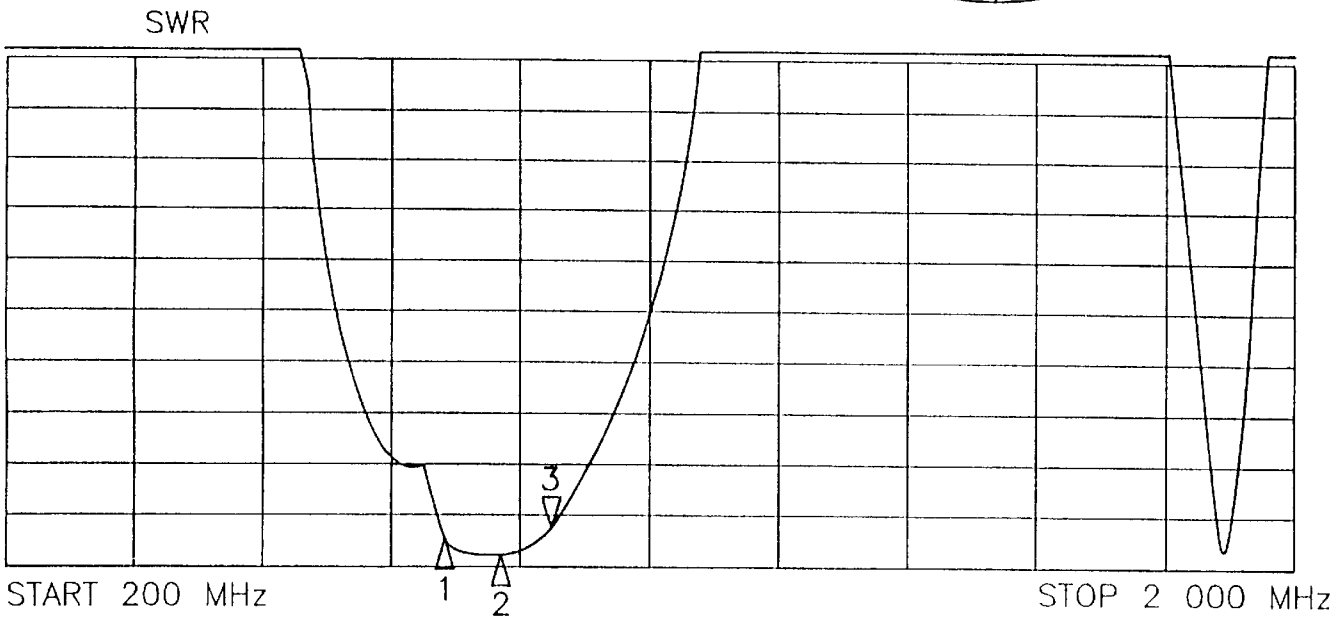

FIGS. 3*a*–3*b* demonstrate how the antenna impedance varies as a function of frequency partly in form of a conventional Smith diagram and partly by a plot showing the antenna standing wave ratio (SWR) for a frequency range of 200 to 2000 Mhz within which is found the antenna operating range 825–970 MHz. FIGS. 3*a*–3*b* refer to the antenna of FIG. 1 when it operates without external influence. The antenna system then exhibits an acceptable frequency bandwidth and the standing wave ratios for three noted reference frequencies 825, 900 and 960 MHz within the operating frequency range are 1:1.73, 1:1.35 and 1:1.79 respectively, which represent acceptable values.

Figure 4A:
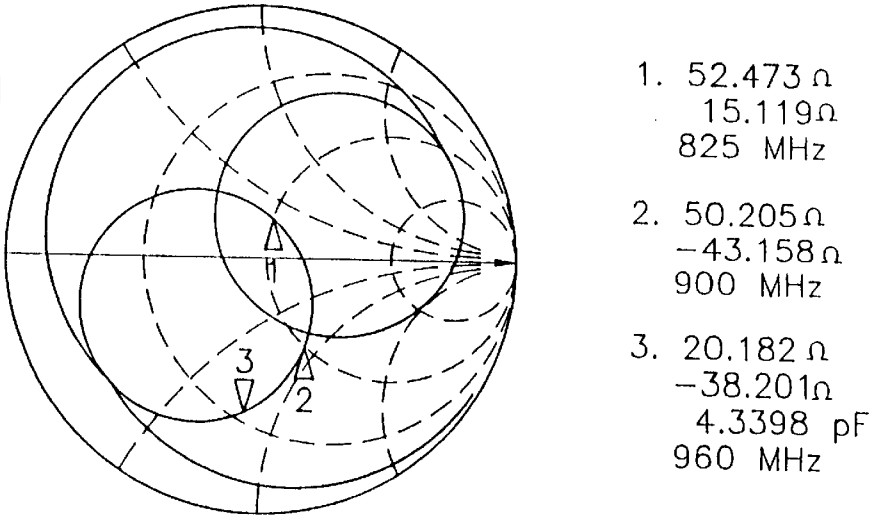
FIGS. 4*a*–4*b* are a Smith diagram and a plot of the standing wave ratio for the antenna according to FIG. 1 when experiencing an external influence by the hand and head of a user.
Figure 4B:
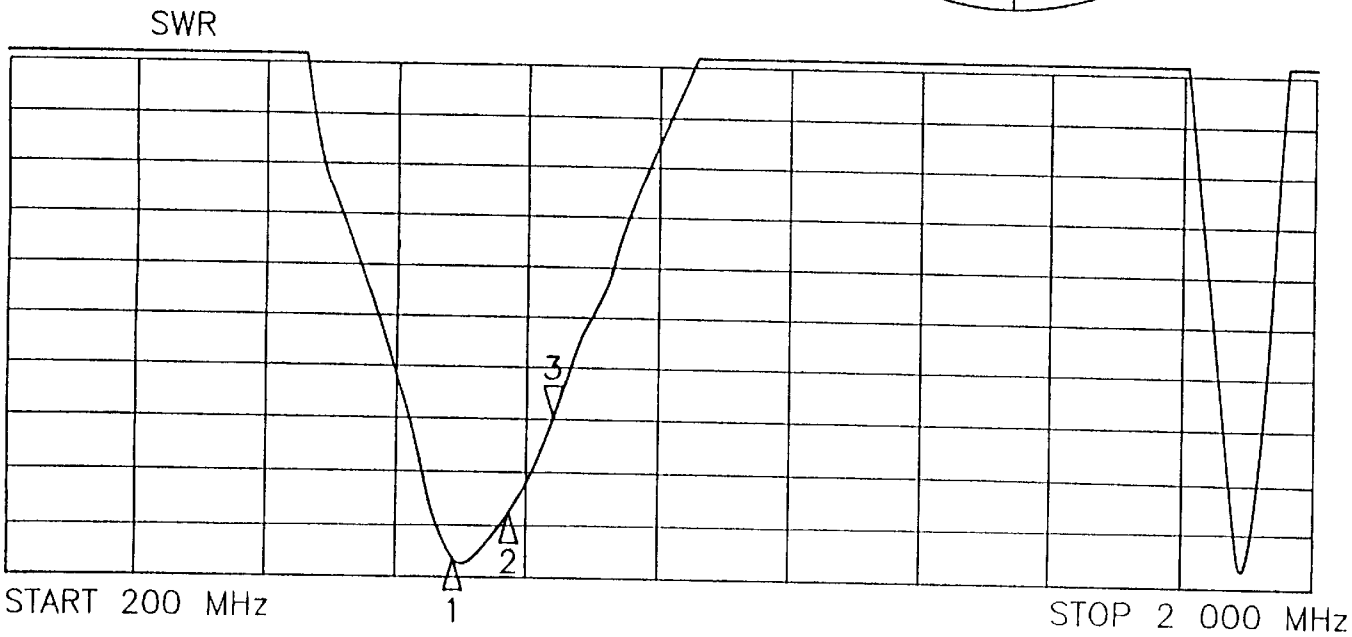

In the same way, FIGS. 4*a*–4*b* demonstrate a corresponding diagram when the equipment is being influenced by the hand and head of a user. For the three measuring points 825, 900 and 960 MHz are now achieved standing wave ratios which are 1:1.35, 1:2.13 and 1:4.09 respectively. Because of the proximity to the hand and head of the user the antenna bandwidth has decreased such that for instance the value at 960 MHz is no longer acceptable at all and the efficiency of the apparatus at the portion to the right of the operating frequency range has generally markedly deteriorated.

Figure 2:
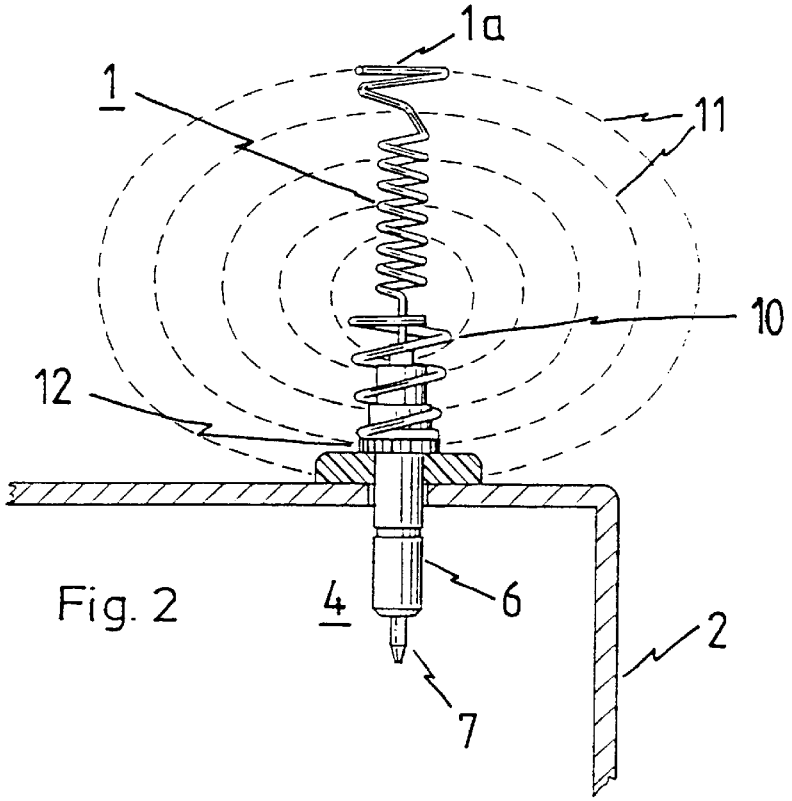
FIG. 2 demonstrates an antenna of FIG. 1 including a member according to the present invention being mounted onto a portable equipment and having a part of its surrounding electric field indicated.

FIG. 2 illustrates in an illustrative embodiment the antenna 1 according to FIG. 1 but provided with an extra member 10 according to the present invention. The extra member 10 has the shape of an upwardly directed open helix having in the illustrative embodiment about four turns. The lower end of the extra member is immediately above an insulating washer 3 connected to the coaxial terminal 4 outer sleeve 6, which is additionally connected to the equipment built-in grounding plane system. In the illustrative embodiment, the sleeve 6 is provided with a flange 12 to which the extra member 10 is connected. This flange 12 in turn is resting against the insulating washer 3. The purpose of the extra member 10 is to raise the electric field around the antenna element of an operating equipment such that less radiated energy will be transferred to the apparatus chassis, which is outlined by the dashed electric field lines 11 of FIG. 2.

Figure 5A:
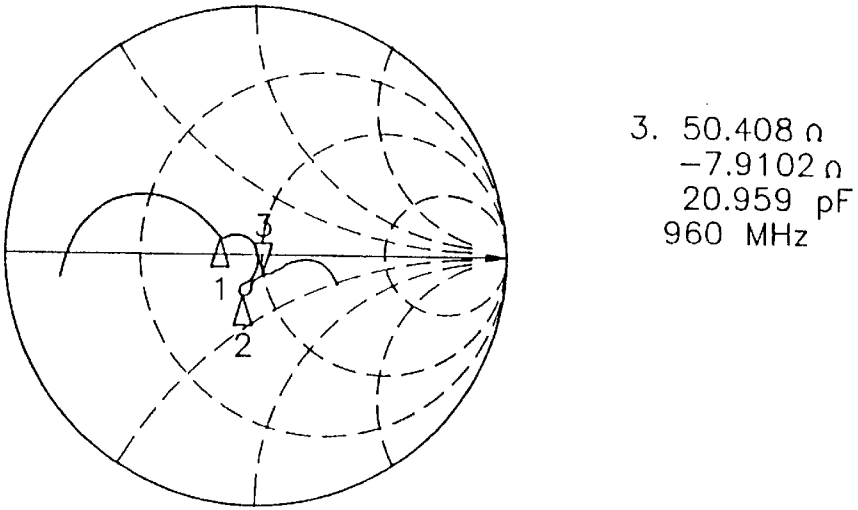
FIGS. 5*a*–5*b* are a Smith diagram and a plot of the standing wave ratio for the antenna having an extra member in accordance to the present invention according to FIG. 2 when experiencing no external influence.
Figure 5B:
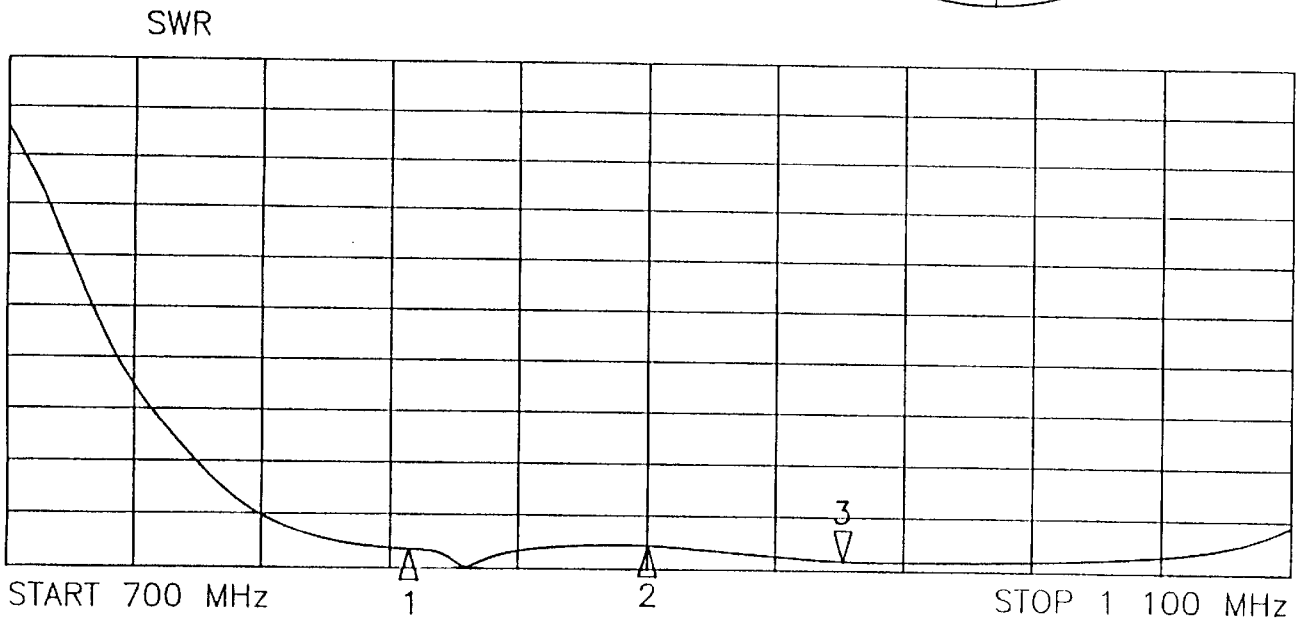

FIGS. 5*a*–5*b* demonstrate how the impedance varies as a function of frequency for the antenna according to the present invention and shown in FIG. 2. By analogy with FIGS. 3*a*–3*b* and 4*a*–4*b*, this is shown in the form of a conventional Smith diagram and in part by a plot demonstrating the antenna standing wave ratio (SWR) for a frequency range 700 to 1100 Mhz within which the antenna operating range 825–970 Mhz is found. FIGS. 5*a*–5*b* refer to the antenna of FIG. 2 when it operates without any external influence. The antenna system then demonstrates an excellent frequency bandwidth and the standing wave ratios for the three reference frequencies 825, 900 and 960 MHz within the operating range are about 1:1.4, 1:1.15 and 1:1.12 respectively, which indicates a good matching to the radio section of the equipment.

Figure 6A:
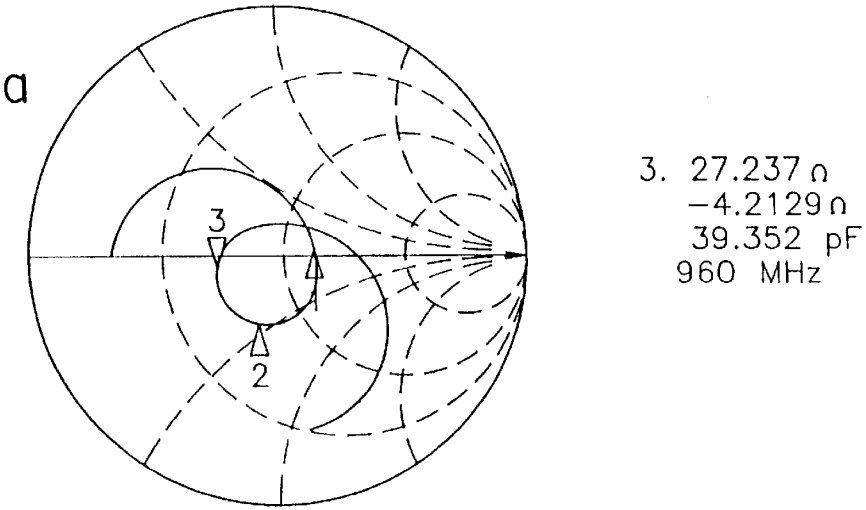
FIGS. 6*a*–6*b* are a Smith diagram and a plot of the standing wave ratio for the antenna having an extra member in accordance to the present invention according to FIG. 2 when experiencing an external influence by the hand and head of a user.
Figure 6B:
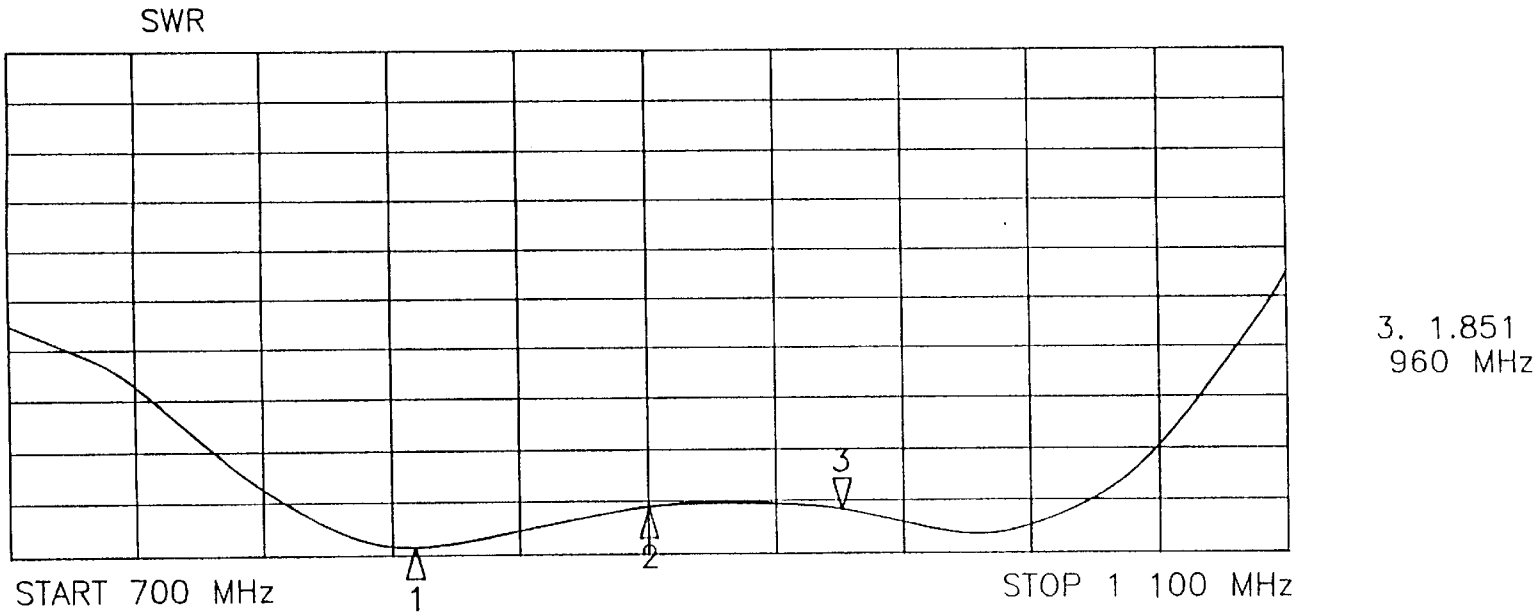

FIGS. 6*a*–6*b* show in the same manner as in FIGS. 5*a*–5*b* a corresponding plot when the equipment is influenced by the hand and head of a user. For the three measuring points 825, 900 and 960 MHz are now obtained standing wave ratios which are 1:1.2, 1:1.9 and 1:1.9 respectively. Because of the proximity of the hand and head of a user the antenna bandwidth has been affected, but due to the extra member 10 according to the present invention this influence is substantially much less and the antenna still maintains a good matching. It will be verified according to the plot of the standing wave ratios that the ratio nowhere within the operating range exceeds 1:2 to be compared to the values which according to FIGS. 4*a*–4*b* were measured for the antenna of FIG. 1 when it was situated in a corresponding surrounding.

From the Smith diagram of FIGS. 3*a*, 4*a*, 5*a* and 6*a* it will be evident for a person skilled in the art how the total impedance of the antenna is distributed between a resistive component and a capacitive or inductive contribution, respectively. Also here by studying the Smith diagram of FIG. 5*a* it is evident that according to the invention the extra member 10 is particularly favorably influencing the antenna element 1 impedance value generally aimed at over the operating frequency range.

In the preferred embodiment, the extra member is preferably tuned to a resonance at or close to the antenna upper limiting frequency, while the built-in grounding plane system in a corresponding manner is tuned at or close to the lower limiting frequency of the antenna 1. According to the present invention, the extra member 10 may be made having a variety of different embodiments like for instance a straight coil or a helix or as a conical helix. Correspondingly the radiator corresponding to the antenna element 1 may of course have a variety of different embodiments familiar to a person skilled in the art. In the preferred embodiment is demonstrated an upwardly slightly conical helix having about four turns with a maximum diameter approximately corresponding to the diameter of the antenna top loop 1*a* while those skilled in the art may apply the method and the arrangement according to the present invention having a straight or a conical helix with more or less turns as a function of a desired operating frequency range without departure from the spirit and scope of the invention as set forth in the appended claims.

I claim:

1. A method for improving efficiency and bandwidth of an antenna of portable equipment comprising a radio transceiver, the method comprising the steps of:

adjusting an impedance and electromagnetic radiation field of said antenna by the introduction of an added conical helix shaped member connected to a grounding plane system of said antenna, wherein the conical helix shaped member and the antenna grounding plane system are electrically insulated from a case of the portable equipment and said added member encircles a lower portion of the antenna; and tuning said added conical helix shaped member for decreasing effects on the antenna operation and its radiation field caused by a user holding said portable equipment provided with said antenna.

2. The method according to claim 1, wherein the added conical helix shaped member is tuned to a resonance frequency within the operation frequency range of the portable equipment, the resonance frequency of said added conical helix shaped member is set at approximately an upper limiting frequency of the operating frequency range, and the antenna grounding plane system is resonantly tuned to a lower frequency within the frequency range in which said portable equipment is supposed to operate, whereby is obtained an increased bandwidth of the antenna system, said effects being strongly reduced by said added conical helix shaped member.

3. The method according to claim 1, wherein said added conical helix shaped member is made as a coaxial screw shaped open coiled line at a lower end of said antenna and is connected to an insulating means at the antenna coaxial input terminal, the inductance of said added conical helix shaped member in cooperation with any stray capacitances forms a resonance frequency corresponding to a quarter-wave element within the operating frequency range and whereby the electromagnetic field is concentrated to an area between the antenna and the added conical helix shaped member, and to the antenna grounding plane system connected to the antenna, the energy transfer to other parts of the portable equipment thereby being reduced.

4. The method according to claim 1, wherein said added conical helix shaped member is made as a coaxial conical helix at a lower end of said antenna and is connected to an insulating means at the antenna coaxial input terminal, said added conical helix shaped member having an inductance that in cooperation with any stray capacitances forms a resonance frequency corresponding to a quarter-wave element within the operating frequency range and whereby the electromagnetic field is concentrated to the area between the antenna and the added conical helix shaped member, and to the antenna grounding plane system connected to the antenna, the energy transfer to other parts of the portable equipment thereby being reduced.

5. An arrangement at an antenna element on a portable equipment comprising a radio transceiver means, said antenna element having a coaxial input terminal with a sleeve and central pin and forming a radiator element for the operating frequency range and having a grounding plane, which is integrated with, but is electrically insulated from, a case of the portable equipment and cooperates with said radiator, the arrangement comprising:

an added member formed as a coaxial screw shape having a cylindrical shape arranged on and encircling the portion of said coaxial input terminal sleeve being outside said case and a portion of the antenna above said input terminal, wherein said added member additionally forms a portion of the grounding plane of said antenna element, wherein said added member operates as a resonance circuit, whereby said added member is adapted to be tuned to an appropriate frequency in association with the antenna operating frequency range.

6. The arrangement according to claim 5, wherein said antenna element is a compact half-wave antenna with a top loop, wherein said added member is a coaxial outward open helix having a maximum diameter approximately corresponding to the top loop diameter, said arrangement being embedded in an electrically non-conducting material to form an antenna device having the shape of a frustrum of a cone.

7. The arrangement according to claim 5, wherein said added member is tuned to a resonant frequency at approximately an upper limiting frequency of said operating frequency range, the grounding plane being tuned to a frequency at the lower limiting frequency of said operating frequency range where the portable equipment should operate to thereby further obtain an increased bandwidth and a reduced influence of the immediate surrounding environment for the antenna element of the portable equipment.

8. The arrangement according to claim 5, wherein said added member is tuned in such a manner that it operates as an electric quarter-wave radiator within a range adjacent to an upper limit of an intended operation frequency range, while the grounding plane is tuned to a frequency at or within an adjacent range at the lower limiting frequency of the intended operating frequency range where the portable equipment should operate to thereby further obtain an increased bandwidth and a reduced influence of the immediate surrounding environment for the antenna element of the portable equipment.

9. An arrangement at an antenna element on an apparatus including a radio transceiver means, said antenna element having a coaxial input terminal with a sleeve and a central pin and forming a radiator which forms a quarter-wave element for the operating frequency range and having a grounding plane that is integrated with an apparatus case, the grounding plane cooperating with said radiator and being electrically insulated from the apparatus case, the arrangement comprising:

an added member formed as a coaxial screw shaped line or helix having a conic shape arranged on and encircling said coaxial input terminal sleeve outside said apparatus case and a portion of the radiator above said input terminal, wherein said added member additionally forms a portion of the grounding plane of said antenna element, wherein said added member operates as a resonance circuit, whereby said added member is adapted to be tuned to an appropriate frequency in association with the antenna operating frequency range.

10. The arrangement according to claim 9, wherein said antenna element is a compact half-wave antenna with a top loop, wherein said added member is a coaxial outward open helix having a maximum diameter approximately corresponding to the top loop diameter, said arrangement being embedded in an electrically non-conducting material to form an antenna device having the shape of a frustum of a cone.

11. The arrangement according to claim 9, wherein said added member is tuned to be resonant at approximately an upper limiting frequency of said operating frequency range, the grounding plane being tuned to a frequency at the lower limiting frequency of said operating frequency range where the apparatus should operate to thereby further obtain an increased bandwidth and a reduced influence of the immediate surrounding environment for the antenna element of the apparatus.

12. The arrangement according to claim 9, wherein said added member is tuned in such a manner that it operates as an electric quarter-wave radiator within a range adjacent to the upper limit of said operating frequency range, while the grounding plane is tuned to a frequency at or within an adjacent range at the lower limiting frequency of said operating frequency range where the apparatus should operate to thereby further obtain an increased bandwidth and a reduced influence of the immediate surrounding environment for the antenna element of the apparatus.

* * * * *